US007126316B1

(12) United States Patent
Dow

(10) Patent No.: US 7,126,316 B1
(45) Date of Patent: Oct. 24, 2006

(54) DIFFERENCE AMPLIFIER FOR REGULATING VOLTAGE

(75) Inventor: Ronald Neal Dow, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 287 days.

(21) Appl. No.: 10/775,528

(22) Filed: Feb. 9, 2004

(51) Int. Cl.
*G05F 1/567* (2006.01)

(52) U.S. Cl. ..... 323/280; 323/907

(58) Field of Classification Search ..... 323/273, 323/280, 281, 907
See application file for complete search history.

(56) References Cited

U.S. PATENT DOCUMENTS 4,908,566 A * 3/1990 Tesch ..... 323/280
5,274,323 A * 12/1993 Dobkin et al. ..... 323/280
5,563,501 A * 10/1996 Chan ..... 323/282
6,046,577 A * 4/2000 Rincon-Mora et al. ..... 323/282
6,246,221 B1 * 6/2001 Xi ..... 323/280
6,300,749 B1 * 10/2001 Castelli et al. ..... 323/273
6,518,737 B1 * 2/2003 Stanescu et al. ..... 323/280
6,559,623 B1 * 5/2003 Pardoen ..... 323/274
6,573,694 B1 * 6/2003 Pulkin et al. ..... 323/273
6,700,360 B1 * 3/2004 Biagi et al. ..... 323/280
6,707,340 B1 * 3/2004 Gough ..... 330/260
6,806,690 B1 * 10/2004 Xi ..... 323/273
6,842,068 B1 * 1/2005 Perrier et al. ..... 327/540
6,856,124 B1 * 2/2005 Dearn et al. ..... 323/280
6,894,469 B1 * 5/2005 Nakajima et al. ..... 323/275
6,933,772 B1 * 8/2005 Banerjee et al. ..... 327/541
6,977,490 B1 * 12/2005 Zhang et al. ..... 323/280

* cited by examiner

*Primary Examiner*—Jeffrey Sterrett

(57) ABSTRACT

A voltage regulation circuit. The voltage regulator includes an input stage, a reference voltage circuit, a gain stage, and an output stage. The reference voltage circuit is coupled to one input of the input stage, and the output stage is coupled to another input of the input stage. The gain stage includes a buffer device coupled to the output of the input stage and a drive circuit coupled to the output stage. The buffer device is operable to provide isolation between the input stage and the drive circuit. The drive circuit may include a first transistor coupled to the output stage, a base current translation circuit, and a current divide circuit coupled to the first transistor and to said base current translation circuit. The input stage may be biased with a substantially constant bias current, such that output dependent current loading effects are avoided.

18 Claims, 6 Drawing Sheets

300

DIFFERENCE AMPLIFIER FOR REGULATING VOLTAGE

TECHNICAL FIELD

The present invention generally pertains to the field of electronic circuits. More particularly, embodiments of the present invention are related to a difference amplifier for regulating a voltage.

BACKGROUND ART

Many electronic circuits have a need for a regulated voltage. FIG. 1 illustrates an example of a conventional difference amplifier 100 that may be used to provide a regulated voltage. The difference amplifier 100 of FIG. 1 regulates a voltage ($V_{out}$) by using voltage feedback in a loop having a differential pair of transistors. The differential pair compares a reference bandgap voltage with a predetermined fraction of the output voltage and produces a drive-signal based on the comparison.

The voltage at the input of transistor Q1 is some fraction of the voltage, $V_{out}$, based on the relative sizes of the voltage divider resistors R1, R2, R3, and R4. The difference amplifier 100 keeps the voltage, $V_{out}$, regulated by forcing the voltage at the input of transistor Q1 to be equal to the reference voltage $V_{ref}$. That is, $V_{out}$ is regulated because any difference between the voltage at the base of transistor Q1 and the voltage at the base of transistor Q2 is forced to zero. By appropriate sizing of voltage divider resistors R1–R4, a suitable voltage $V_{out}$ may be maintained.

While the conventional difference amplifier illustrated in FIG. 1, as well as other conventional difference amplifiers, are well-suited for a number of applications, they have several limitations.

First, such conventional difference amplifies are often designed to operate over a relatively limited range in output current. However, for some applications a wider range in output current is required, or at least desired. Second, such circuits are often designed to output a single fixed output voltage. However, for some applications it is required, or at least desired, to have a circuit that is able to accurately output a variety of output voltages.

If a difference amplifier such as the one illustrated in FIG. 1 is attempted to be used over too wide a range in output current, the circuit exhibits errors in output voltage as the output current varies. For example, the circuit may only hold to about 85 to 100 milli-volts with a 5 volt output over an output current range from 100 microamperes to 150 milliamperes. A further limitation of the conventional circuit 100 illustrated in FIG. 1 is that the power supply rejection with the input voltage going from 6 volts to 60 volts is approximately 20 to 30 milli-volts.

Thus, a need exists for a voltage regulation circuit. A further need exists for a voltage regulation circuit that provides good performance over a wide range in output current. A further need exists for a voltage regulation circuit that is able to accurately output a variety of regulated voltages. A still further need exists for a voltage regulation circuit that has a good power supply rejection ratio over a wide range of input supply voltages. A still further need exists for a voltage regulation circuit that is compatible with and can be fabricated economically with existing semiconductor fabrication techniques.

SUMMARY

The present invention provides a voltage regulation circuit. Embodiments of the present invention provide a voltage regulation circuit that provides good performance over a wide range in output current. Embodiments of the present invention provide a voltage regulation circuit that is able to accurately output a variety of regulated voltages. Embodiments of the present invention provide a voltage regulation circuit that has a good power supply rejection ratio over a wide range of input supply voltages. Embodiments of the present invention provide a voltage regulation circuit that is compatible with and can be fabricated economically with existing semiconductor fabrication techniques.

A voltage regulation circuit is disclosed. In one embodiment in accordance with the present invention, the voltage regulator comprises an input stage, a reference voltage circuit, a gain stage, and an output stage. The reference voltage circuit is coupled to one input of the input stage, and the output stage is coupled to another input of the input stage. The gain stage includes a buffer device coupled to the output of the input stage and a drive circuit coupled to the output stage. The buffer device is operable to provide isolation between the input stage and the drive device.

The drive circuit of the voltage regulation circuit just described may be implemented with field effect devices or bipolar devices, in accordance with different embodiments of the present invention. In one embodiment in accordance with the present invention, the drive circuit of the circuit just described comprises a field effect transistor. In another embodiment in accordance with the drive circuit comprises a first transistor coupled to the output stage, a base current translation circuit, and a current divide circuit coupled to the first transistor and to the base current translation circuit. The current divide circuit is operable to deliver a portion of a first current of the first transistor to the base current translation circuit. Furthermore, the base current translation circuit is operable to deliver to the base of the first transistor a second current. This second current may be greater in magnitude than a base current of the first transistor.

The biasing of the input stage of the voltage regulation circuit just described may be implemented with fixed and/or output dependent currents, in accordance with different embodiments of the present invention. In one embodiment in accordance with the present invention, the input stage has an impedance coupled thereto. The input stage is biased with a substantially constant bias current, such that output dependent current loading effects through the impedance are avoided. In another embodiment in accordance with the present invention, the input stage is biased, at least in part, with a current source whose magnitude depends on the magnitude of an output current.

These and other advantages of the present invention will no doubt become obvious to those of ordinary skill in the art after having read the following detailed description of the preferred embodiments, which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail as not to unnecessarily obscure aspects of the present invention.

Figure 1:
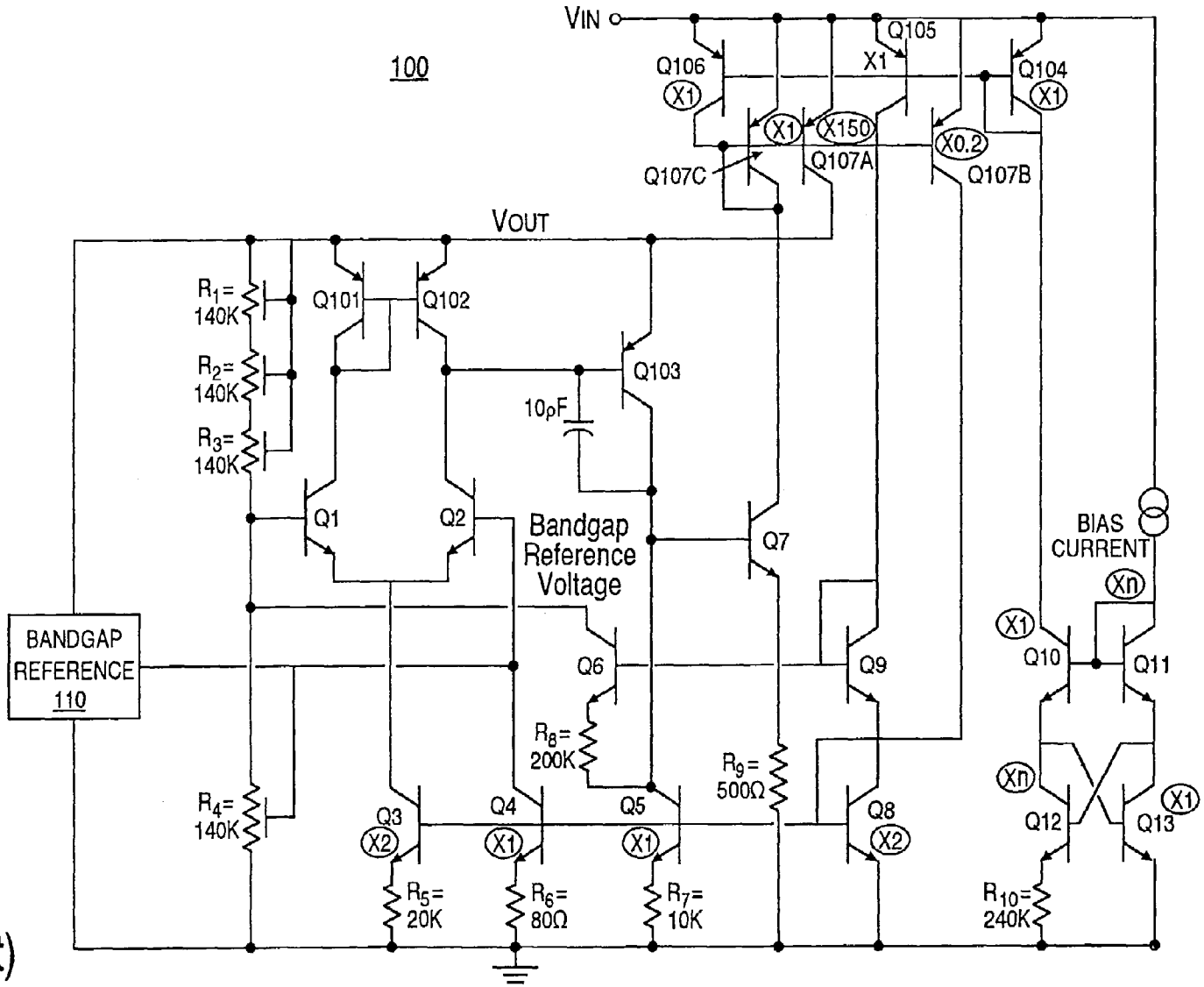
Fig. 1 (Prior Art)
FIG. 1 is a schematic of a conventional circuit for regulating voltage.

FIG. 1 is a schematic of a conventional circuit 100 for regulating voltage. The following explanation of the conventional circuit 100 illustrated in FIG. 1 will serve to highlight limitations of that conventional design. Embodiments of the present invention overcome these limitations. The conventional difference amplifier 100 of FIG. 1 has a differential pair formed by npn transistors Q1 and Q2. The base of transistor Q1, the inverting input of the differential pair, is coupled to the output voltage ($V_{out}$) via a series of resistors, R1, R2, and R3. Resistor R4 is coupled between the base of transistor Q1 and ground. Thus, a pre-determined fraction of the output voltage is fed to the inverting input of the differential pair. The non-inverting input of the differential pair, the base of transistor Q2, is coupled to the output of the bandgap reference voltage 110, such that a reference voltage is supplied to the non-inverting input. The reference voltage may be, for example, 1.25 volts.

Transistors Q3, Q4, and Q5 serve as current sources. Transistor Q3 is coupled from the emitters of the input differential pair to ground via resistor R5. Transistor Q4 is coupled from the non-inverting input of the differential pair to ground via resistor R6. Pulldown current source transistor Q5 is coupled between transistor Q103 and ground via resistor R7. The bases of these current sources are biased with a mix of a fixed current source and a current source that varies with the output current. Transistor Q105 provides the fixed current source. One of the output transistors, transistor Q107B, provides the current that varies with the output by supplying a pre-determined fraction of the output current.

The output transistors comprise transistors Q107A, Q107B, and Q107C. The collector of transistor Q7 establishes the base currents for output transistors Q107A, Q107B, and Q107C. Output transistor Q107B supplies the aforementioned portion (×0.2) of the output current to transistor Q8. That is, Q107B provides the portion of the biasing current for transistors Q3, Q4, and Q5 that varies with the output current. Transistor Q8 is configured as a diode with its emitter coupled to ground and has its base and collector coupled to the bases of transistors Q3, Q4, and Q5, such that transistor Q8 provides a biasing current for transistors Q3, Q4, and Q5. Output transistor Q107A is coupled to the inverting input transistor Q1 through resistors R1, R2, and R3. Diode connected output transistor Q107C reduces the beta of the output transistor when the output transistor is actively putting out a current.

A differencing circuit formed by transistors Q101 and Q102 passes the drive signal from the differential pair of transistors Q1 and Q2 to an output transistor Q103. Transistor Q103 provides the base current to transistor Q7, which is coupled to ground via resistor R9. Transistor Q103 also provides current to the current source transistor Q5. The conventional circuit of FIG. 1 requires a 10 pico-farad capacitor across transistor Q103 for stability. Embodiments of the present invention provide a stable circuit while using a much smaller capacitor in a similar location. Transistor Q6, which is coupled to ground via resistor R8, is a biasing device that keeps the inputs from getting lost upon power up.

The conventional circuit of FIG. 1 comprises a proportional to absolute temperature (PTAT) circuit formed by transistors Q10, Q11, Q12, and Q13 and resistor R10. The PTAT circuit produces an offset voltage. If the temperature coefficient of the resistor R10 is about positive 3300 ppm/C, then the PTAT produces a bias current with a substantially constant magnitude of about 640 nano-amperes. This bias current is independent of supply voltage and is used to bias the difference amplifier 100 through transistors Q105 and Q107B.

The conventional circuit of FIG. 1 will hold to within about 85–100 milli-volts with a 5 volt output over an output current range from 100 microamperes to 150 milli-amperes. The reasons for the problems are as follows. The base current from the inverting input transistor Q1 varies as the output current varies. More particularly, this base current varies with the output current because the biasing current from transistor Q8 is logarithmically related to the output current of transistor Q107B. The varying base current of transistor Q1 flowing in resistors R1, R2, R3, and R4 detracts from the performance of the circuit 100, as it causes output voltage errors as the output current varies.

Furthermore, the power supply rejection for the conventional circuit in FIG. 1 is such that as the input voltage ranges from 6 volts to 60 volts, there is an output voltage error of about 20 to 30 milli-volts. The reason for this error is related to the principle that the base current of transistor Q7 decreases as the input voltage increases. Therefore, for a given output current, the current through transistor Q7 decreases as the input voltage increases. Also, there is a small loading of the output transistor Q107A through transistor Q103, which decreases as the input voltage increases.

Figure 2:
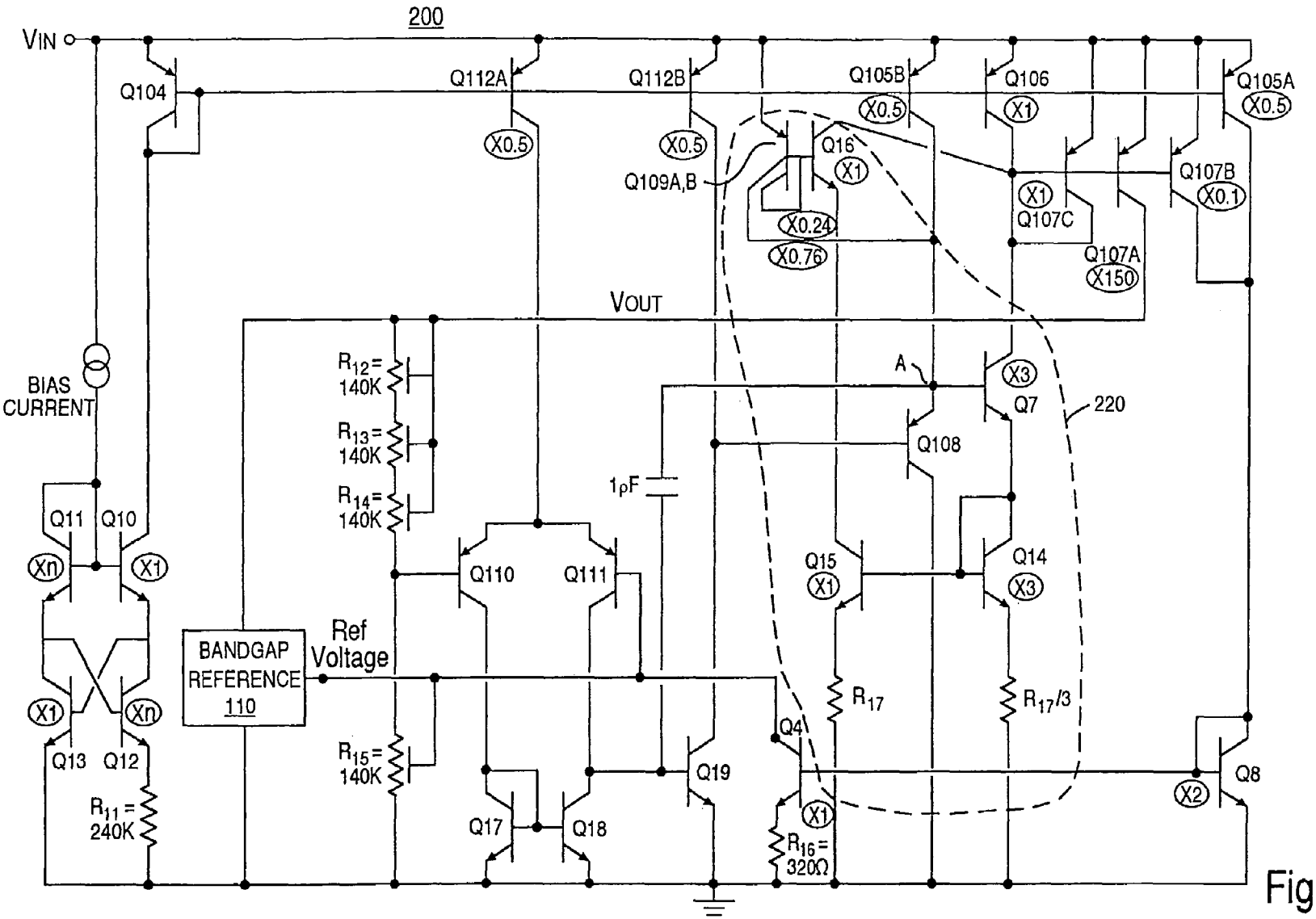
FIG. 2 is a schematic of a circuit that regulates voltage using an isolation buffer, according to an embodiment of the present invention.

FIG. 2 is a schematic of a circuit 200 that regulates voltage using an isolation buffer and fixed input stage biasing, according to an embodiment of the present invention. The voltage regulation circuit of the embodiment illustrated in FIG. 2 is in some ways similar to the conventional voltage regulation circuit of FIG. 1. However, there are significant differences that provide for superior performance over the circuit of FIG. 1. For example, the embodiment of FIG. 2 is stable with a capacitor that is an order of magnitude less than the capacitor of the conventional circuit of FIG. 1. Also, the embodiment of the present invention illustrated in FIG. 2 provides response that does not vary nearly as much with changes in output current as does the conventional circuit of FIG. 1. This enables the embodiment illustrated in FIG. 2 to provide a much more desirable response over a much wider range in output current than the conventional circuit of FIG. 1.

The differencing circuit 200 of FIG. 2 has an input differential pair comprising transistors Q110 and Q111. The inverting input, transistor Q110, receives a fractional portion of the output voltage ($V_{out}$). Resistors R12, R13, R14, and R15 divide the output voltage, such that a pre-determined fraction of the output voltage is applied to the base of transistor Q110. The transistors Q110 and Q111 are pnp transistors, in this embodiment. However, other embodiments use npn transistors for the input differential pair.

The non-inverting input of the differential pair, transistor Q111, receives a bandgap reference voltage from the bandgap reference circuit 110. The bandgap reference voltage may be, for example, 1.25 volts. However, the present invention is well suited to using bandgap reference voltages of other magnitudes. The bandgap reference circuit 110 has nodes coupling it between the output voltage and ground. The output of the bandgap reference circuit 110 is coupled to the collector of transistor Q4, in addition to the non-inverting input of the differential pair Q111.

Transistor Q4 is coupled to ground via resistor R16 and has its base coupled to the base of transistor Q8. Transistor Q8 is diode connected and has its collector coupled to the collectors of fixed biasing current transistor Q105A and one of the output transistors Q107B. In the embodiment illustrated in FIG. 2, the sizes of these transistors are as follows. Transistor Q8 is ×2, fixed bias current transistor Q105A is ×0.5, and output transistor Q107B is ×0.1. However, the invention is not limited to these transistor sizes.

In the embodiment illustrated in FIG. 2, the bias current for the input stage of the difference amplifier is relatively small and fixed. This alleviates errors due to output current dependent loading. For example, the base current of the transistor Q110 is not dependent on the output current of any of the output transistors Q107A, Q107B, and Q107C. Thus, there is no deleterious output current dependent voltage across resistors R12, R13, R14, and R15 from the base current of transistor Q110. As previously stated, the magnitude of the base current of transistor Q110 is relatively small. For example, in one embodiment of the present invention, the magnitude of the PTAT bias current is about 640 nano-amperes, the ratio of transistor Q112A to transistor Q104 is 0.5, and the beta of the differential pair transistors Q110 and Q111 is about 1200. These parameters result in a base current for transistor Q110 of about 133 pico-amperes.

Continuing with the discussion of the embodiment illustrated in FIG. 2, a differencing circuit comprising transistors Q17 and Q18 is coupled to the collectors of the differential pair Q110 and Q111. Consequently, the signal from the input differential pair Q110 and Q111 is passed on to the gain stage, discussed later herein.

The collector of transistor Q19 is loaded from a fixed current source from transistor Q112B. The collector of transistor Q19 is coupled to the base of buffer transistor Q108, thus driving buffer transistor Q108. Reference point A, which is at the base of transistor Q7, is a sensitive location in the circuit 200. Transistor Q108 provides isolation between transistor Q19 and transistor Q7. From the emitter of buffer transistor Q108 there is a very low impedance going to the base of transistor Q7. Buffer transistor Q108 may have a relatively large beta. For example, in one embodiment of the present invention, the beta of transistor Q108 is at least approximately 2000. In the embodiment illustrated in FIG. 2, the compensation capacitor from the emitter of transistor Q108 to the base of buffer transistor Q19 is only about 1 pico-farad. Thus, this embodiment is able to provide a stable circuit while using a capacitor that is an order of magnitude smaller than the conventional solution illustrated in FIG. 1.

Another aspect of the circuit of FIG. 2 is the ability to shut down the current path to transistor Q107 when the output of the input stage gets close to ground. That is, to shut down the current to transistor Q107 when the collector of transistor Q19 is close to ground. Furthermore, the embodiment illustrated in FIG. 2 will operate well with output currents down to about 100 microamperes, or less. The collector of transistor Q7 is coupled to the collector of output transistor Q107C. The collector of transistor Q7 is also coupled to the bases of output transistors Q107A, Q107B, and Q107C. Transistor Q7 thus provides the base current drive to output transistors Q107A, Q107B, and Q107C. Transistor Q106, which has its base coupled to transistor Q104, provides a drive current for transistor Q7. The base of transistor Q7 is coupled to the emitter of transistor Q108.

The shutdown of the current path to transistor Q107 functions as follows. Transistors Q14 and Q15 form a current divider. If the current path to transistor Q107 is on, one-third of the current in Q7 is replicated from transistor Q14 to transistor Q15. Transistor Q16, which is coupled in series with transistor Q15, will then also have the same current as transistor Q15. Transistor Q16 may have approximately the same beta as transistor Q7. The base current of transistor Q16 is replicated in an X(3+) current mirror formed by transistors Q109A and Q109B. That is, the ratio of transistor Q109A to Q109B is slightly greater than three to one. For example, the size of transistor Q109A may be ×0.76, whereas the size of transistor Q109B is ×0.24. However, other sizes may be used. Throughout this description transistors Q16, Q109A, and Q109B may be referred to as a base current translation current. In this embodiment, the collector of transistor Q16 is not coupled to the input voltage, but rather is coupled to the bases of transistors Q107A, Q107B, and Q107C.

The collector of transistor Q109A feeds the base of transistor Q7. Once fixed biasing current transistor Q105B turns on to deliver the fixed biasing current, transistor Q7 provides a large portion of its own base current from the positive supply voltage rather than from the bandgap reference voltage or the output voltage. Moreover, very little of this current passes through the emitter of transistor Q108. In the embodiment illustrated in FIG. 2, the transistor Q7 and its associated components, transistors Q14, Q15, Q16, Q109A, and Q109B implement what is referred to herein as a drive circuit. However, the drive circuit may be implemented with a single field effect device, as discussed herein. Throughout this description the combination of the drive circuit and the buffer transistor Q108 may be referred to as a gain stage 220.

In the embodiment illustrated in FIG. 2, the current divider formed by transistors Q14 and Q15 is a one-third current divider. However, other fractions/multiples may be used. For example, transistor Q14 is three times the size as transistor Q15. Furthermore, the resistor from transistor Q15 to ground has three times the resistance as the resistor between the emitter of transistor Q14 and ground. However, the present invention is well suited to other transistor ratios and resistor ratios.

The embodiment illustrated in FIG. 2 uses a PTAT current source. In this embodiment, the PTAT provides a fixed current of approximately 640 nano-amperes, as described herein. However, the present invention is not limited to this current magnitude. The fixed current from the PTAT source is used to bias transistors Q105, Q106, Q112A, and Q122B.

The embodiment of the present invention illustrated in FIG. 2 has less than 1 milli-volt in output voltage change when the output voltage is 5 volts and the output current varies between 100 microamperes and 150 milli-amperes. The power supply feed-through is less than 2 milli-volts with the input voltage ranging from 6 volts to 60 volts at a particular junction temperature. Thus, the embodiment of the present invention illustrated in FIG. 2 provides substantially superior results as compared to the conventional circuit illustrated in FIG. 1.

Figure 3:
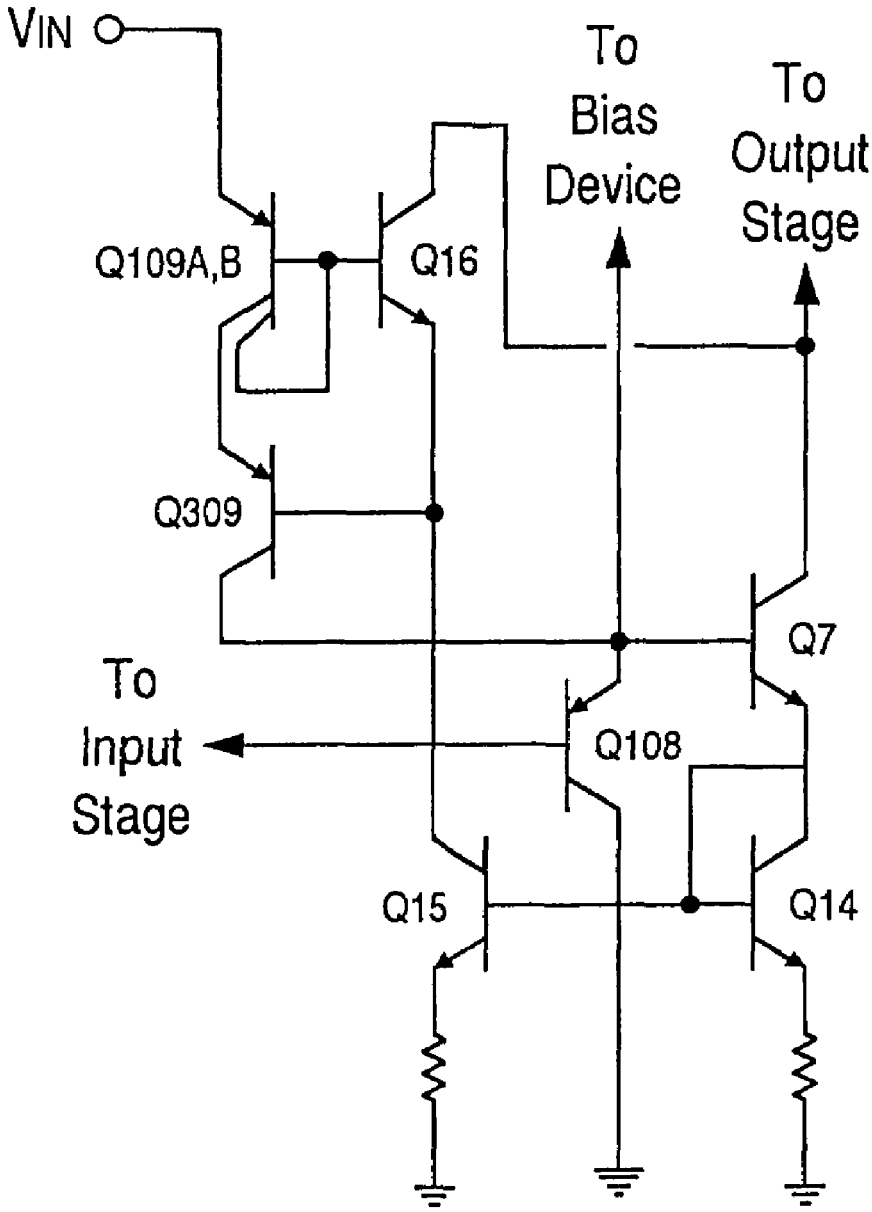
FIG. 3 is a schematic of a gain stage using a cascode transistor and base current translation, according to an embodiment of the present invention.

Many variations to the circuit illustrated in FIG. 2 are within the scope of the present invention. FIG. 3 illustrates an embodiment in accordance of the present invention in which a pnp cascode transistor Q309 is used in a gain stage. The gain stage 300 illustrated in the embodiment of FIG. 3 may replace the gain stage 220 of the circuit 200 of FIG. 2. The base of the pnp cascode transistor Q309 is coupled to the emitter of transistor Q16. The emitter of the pnp cascode transistor Q309 is coupled to the collector of transistor Q109A to receive the current from transistor Q109A. The embodiment of the present invention illustrated in FIG. 3 may provide additional stability in the output current with variation in the input voltage, as compared to the embodiment illustrated in FIG. 2 because taking out the Early voltage of transistor Q109A.

Figure 4:
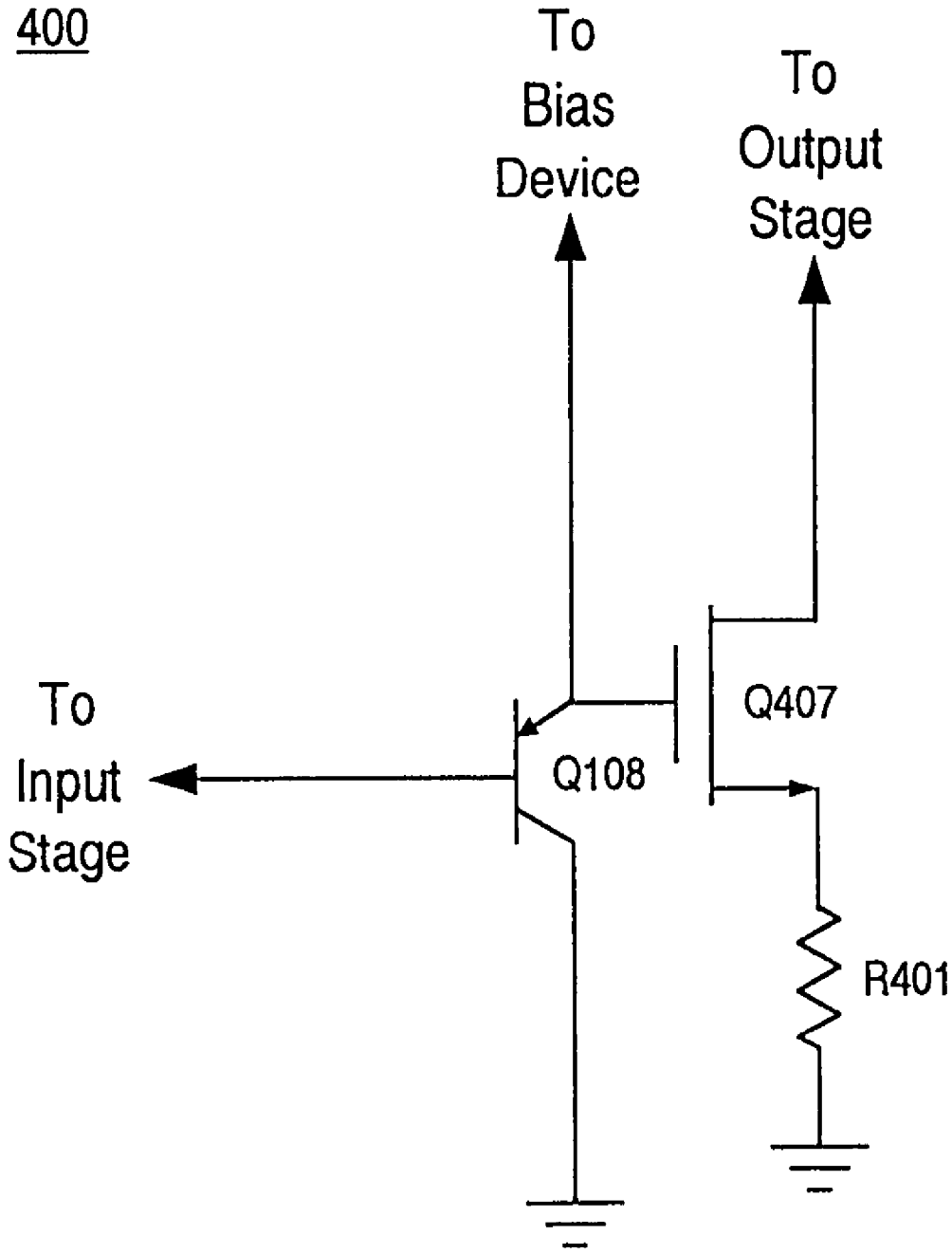
FIG. 4 is a schematic of a gain stage using a field effect transistor device and that may be used in a circuit that regulates voltage, according to an embodiment of the present invention.

Referring now to FIG. 4, in another embodiment, a field effect transistor is used in a gain stage 400. The gain stage 400 illustrated in the embodiment of FIG. 4 may replace the gain stage 220 of the circuit 200 of FIG. 2. For example, referring to FIG. 2, transistor Q7 and its base drive components may be replaced with an n-channel device. The base drive components comprise transistors Q14, Q15, Q16, 109A, and Q109B, in FIG. 2. FIG. 4 illustrates with its gate coupled to the emitter of transistor Q108 and its source coupled to ground via resistor R401. The drain of the n-channel device may be coupled to the output stage. For example, in of the n-channel device may be coupled to the base/collector of transistor Q107C.

In the embodiment illustrated in FIG. 2, the biasing for the emitter of transistor Q108 is fixed using the collector of fixed bias current transistor Q105B. Alternatively, biasing for the emitter of transistor Q108 may be variable, based on a fraction of the current from output transistor Q107B.

Figure 5:
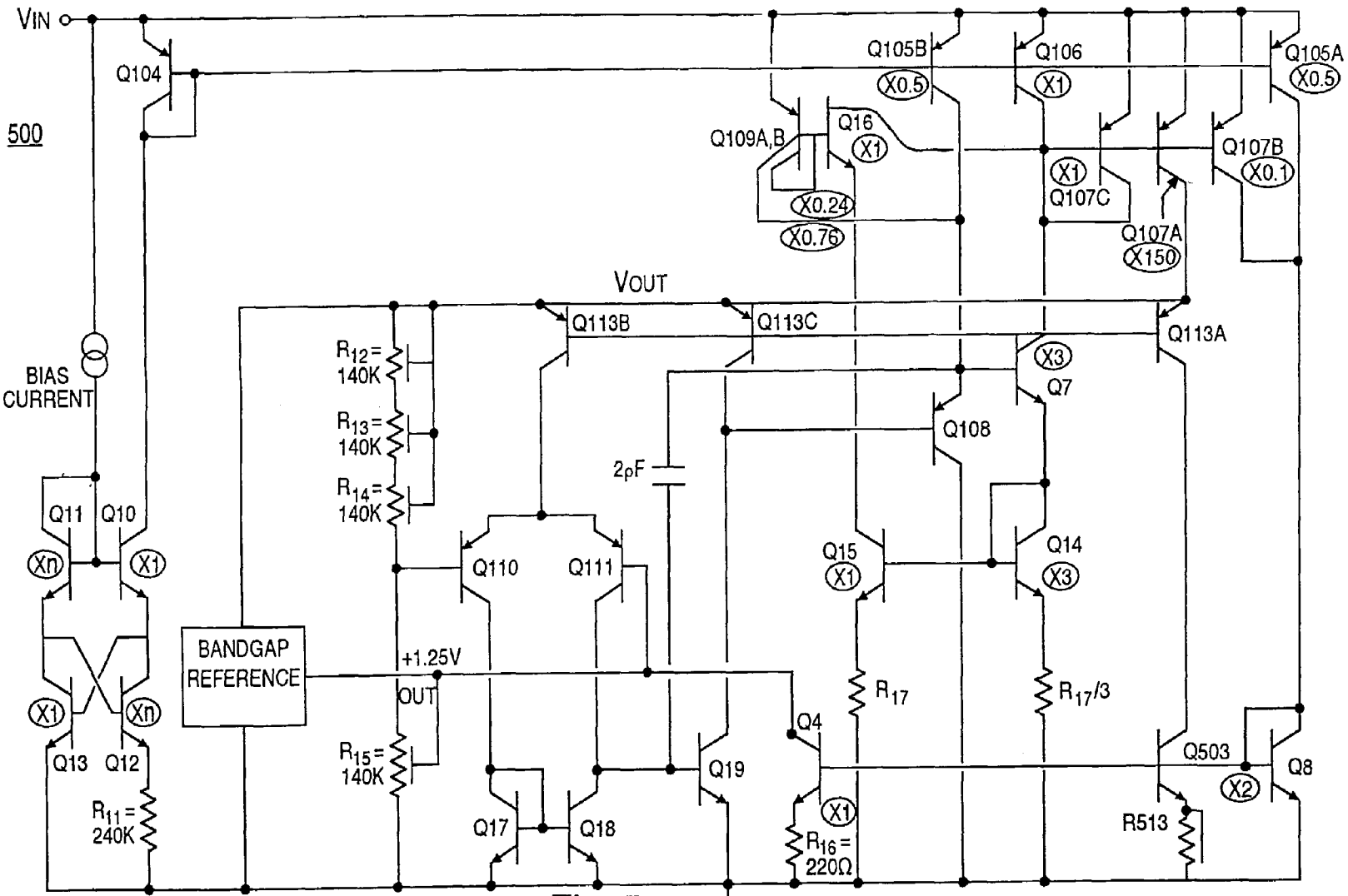
FIG. 5 is a schematic of a circuit that regulates voltage using an isolation buffer and output current dependent biasing, according to an embodiment of the present invention.

In the embodiment illustrated in FIG. 2, the biasing for the input stage is from a fixed current source. In another embodiment, the fixed current biasing of the input stage is replaced with variable biasing of the input stage. FIG. 5 is a schematic of a circuit that regulates voltage using an isolation buffer and output current dependent biasing, according to an embodiment of the present invention. In the present embodiment, transistors Q112A and Q112B are not used as fixed bias current sources. Rather, transistors Q113B and Q113C are used as variable bias current sources. More particularly, the emitter of transistor Q113A is coupled to the output transistor Q107A. Transistor Q503 is coupled to the collector of transistor Q113A and to ground via resistor R513. The bases of transistors Q113B and Q113C are coupled to the base/collector of transistor Q113A. The emitters of Q113B and Q113C are coupled to the output voltage. The collector of transistor Q113B is coupled to the emitters of the input pnp differential pair Q110, Q111 to provide a bias current that depends on the output current of output transistor Q107B. The collector of transistor Q113C is coupled to the collector of transistor Q19 to provide a similar variable biasing current.

Figure 6:
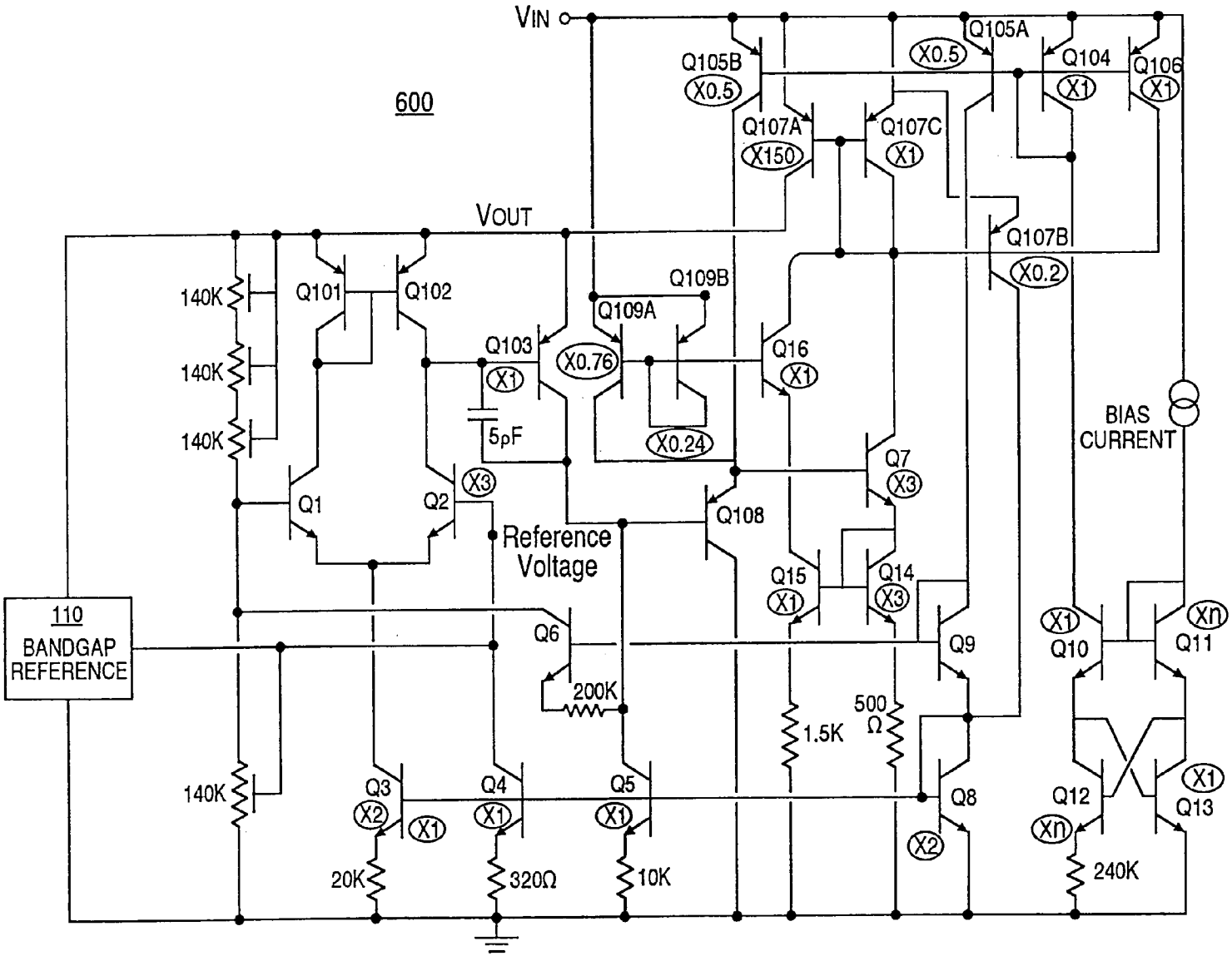
FIG. 6 is a schematic of a circuit that regulates voltage, using npn input transistors and output current dependent biasing, according to an embodiment of the present invention.

FIG. 6 is a schematic of a circuit 600 that regulates voltage, using npn input transistors and output current dependent biasing, according to an embodiment of the present invention. The voltage regulation circuit of the embodiment illustrates in FIG. 6 is in some ways similar to the conventional voltage regulation circuit of FIG. 1. However, there are significant differences that provide for superior performance over the circuit of FIG. 1. For example, the embodiment of FIG. 6 is stable with a capacitor that is half the magnitude of the capacitor of the conventional circuit. Also, the circuit of FIG. 6 provides response that does not vary nearly as much with changes in output current as does the conventional circuit of FIG. 1. This enables the circuit of FIG. 6 to provide a much more desirable response over a much wider range in output current than the conventional circuit of FIG. 1.

The embodiment of the present invention illustrated in FIG. 6 has an npn input differential pair Q1 and Q2 and differencing circuit Q101 and Q102. The circuit 600 also has an output transistor Q103. However, the capacitor coupled between the base and collector of the output transistor Q103 is only 5 pico-farads.

The embodiment of FIG. 6 also comprises a buffer transistor Q108. This buffer transistor Q108 may have a gain that is approximately unity or somewhat less than unity, in accordance embodiments of the present invention. Transistor Q7 proves a base current drive to the output device, transistors Q107A, Q107B, and Q107C. One third of this drive current is produced from the collector of transistor Q15 and is fed through the emitter of sensing transistor Q16. The base of sensing transistor Q16 is applied to diode connected pnp transistor Q109B. The collector of Q16 is coupled to the bases of transistors Q107A, Q107B, and Q107C. A multiple of the collector current from transistor Q109B is supplied from the collector of Q109A to the base of transistor Q7 to supply the base current of transistor Q7. This multiple is slightly above three so that at low supply voltage the current from the collector of Q109A minus the base current of Q7 is positive.

Embodiments of the present invention may use npn or pnp devices. Moreover, the present invention is not limited to bipolar junction devices, for example, metal oxide field effect devices may also be used. Embodiments of the present invention may use p-channel devices or n-channel devices. Embodiments of the present invention are well suited for use as low-dropout (LDO) voltage regulators.

Therefore, it will be seen that embodiments of the present invention provide voltage regulation. Embodiments of the present invention provide a voltage regulation circuit that provides good performance over a wide range in output current. Embodiments of the present invention provide a voltage regulation circuit that has a good power supply rejection ratio over a wide range of input supply voltages. Embodiments of the present invention provide a voltage regulation circuit that is compatible with and can be fabricated economically with existing semiconductor fabrication techniques.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A voltage regulator comprising:

an input stage having a first input, a second input, and an output;

a reference voltage circuit coupled to said first input;

an output stage coupled to said second input; and a gain stage comprising a buffer device and a drive circuit, said buffer device coupled to said output of said input stage and said drive circuit, said drive circuit coupled to said output stage, said drive circuit comprising:

a first transistor coupled to said output stage;

a base current translation circuit; and a current divide circuit coupled to the first transistor and to said base current translation circuit, wherein said current divide circuit is operable to deliver a portion of a first current of said first transistor to said base current translation circuit; and wherein said base current translation circuit is operable to deliver to the base of said first transistor a second current;

wherein said buffer device is operable to provide isolation between said input stage and said drive circuit.

2. The voltage regulator of claim 1, wherein said drive circuit comprises a field effect transistor.

3. The voltage regulator of claim 1, further comprising a proportional to absolute temperature circuit coupled to said input stage and said gain stage and operable to provide a biasing current that is substantially independent of temperature.

4. The voltage regulator of claim 1, wherein said second current is greater in magnitude than a base current of the first transistor.

5. The voltage regulator of claim 1, further comprising a capacitor coupled to said buffer device and said input stage, and wherein said buffer device comprises a beta of approximately at least 1000.

6. The voltage regulator of claim 1, further comprising:

an impedance coupled to said second input of the input stage and to said output stage; and a device coupled to said input stage to provide a substantially constant bias current for said input stage, wherein output dependent current loading effects through said impedance are avoided.

7. A low dropout voltage regulation circuit comprising:

an input comparison stage having an inverting input, a non-inverting input, and an output, said inverting input coupled to an output voltage node;

a bandgap reference voltage circuit coupled to said non-inverting input;

a low dropout output stage coupled to an input voltage node and the output voltage node; and a gain stage comprising a buffer device and a drive circuit, said buffer device coupled to said output of said input stage and said drive circuit, said drive circuit coupled to said output stage, said drive circuit comprising a first transistor coupled to said output stage;

a base current translation circuit; and a current divide circuit coupled to the first transistor and to said base current translation circuit, wherein said current divide circuit is operable to deliver a portion of a first current of said first transistor to said base current translation circuit; and wherein said base current translation circuit is operable to deliver to the base of said first transistor a second current that is greater in magnitude than a base current of the first transistor;

wherein said buffer device is operable to provide isolation between said input stage and said drive circuit.

8. The voltage regulator of claim 7, further comprising:

a biasing device coupled to said input comparison stage and to said output stage, wherein said biasing device is configured to provide a bias current to said input stage that is linearly proportional to an output current of said output stage.

9. The regulation circuit of claim 7, wherein said buffer device comprises a pnp transistor.

10. The voltage regulator of claim 7, further comprising:

a biasing device coupled to said input comparison stage and to said output stage, wherein said biasing device is configured to provide a bias current to said input stage that is logarithmically related to an output current of said output stage.

11. The voltage regulator of claim 7, wherein said drive circuit comprises a field effect transistor.

12. The voltage regulator of claim 7, further comprising:

an impendence coupled to said inverting input of the input comparison stage and to said output stage; and a transistor coupled to said input comparison stage to provide a substantially constant bias current for said input stage, wherein output dependent current loading effects through said impedance are avoided.

13. A voltage regulation circuit comprising:

an input comparison stage comprising a first pnp transistor and a second pnp transistor, said first pnp transistor coupled to an output voltage node;

a bandgap reference voltage circuit coupled to said second pnp transistor;

an output stage coupled to an input voltage node and the output voltage node; and a gain stage comprising:

a third pnp transistor coupled to said output of said input stage;

a drive transistor coupled to said third pnp transistor and said output stage;

mirror transistors coupled to said drive transistor; and a translation circuit coupled to the mirror transistors;

wherein the mirror transistors are operable to deliver a portion of a first current of said drive transistor to said translation circuit; and wherein said translation circuit is operable to deliver to the base of said drive transistor a second current that is greater in magnitude than a base current of said drive transistor.

14. The voltage regulator of claim 13, further comprising a proportional to absolute temperature circuit coupled to said input stage and said gain stage and operable to provide a biasing current that is substantially independent of temperature.

15. The voltage regulator of claim 13, further comprising:

an impendence coupled to said first pnp transistor and to said output voltage node; and a biasing transistor coupled to said input comparison stage to provide a substantially constant bias current for said input stage, wherein output dependent current loading effects through said impedance are avoided.

16. The voltage regulator of claim 13, wherein said third pnp transistor is configured as a substantially unity gain buffer.

17. The voltage regulation circuit of claim 13, wherein said translation circuit comprises a first translation transistor coupled to the mirror transistors and a second translation transistor coupled to the base of the drive transistor.

18. The voltage regulator of claim 17, further comprising a pnp cascode transistor having a base coupled to said first translation transistor and an emitter coupled to said second translation transistor.

* * * * *